United States Patent [19]

Ueda

[11] 4,322,917

[45] Apr. 6, 1982

[54] DOUBLE-HEAD AUTOMATIC GRINDING MACHINE

[75] Inventor: Minoru Ueda, Yamato, Japan

[73] Assignee: Ueda Giken Co., Ltd., Yamato, Japan

[21] Appl. No.: 134,466

[22] Filed: Mar. 27, 1980

[30] Foreign Application Priority Data

Apr. 5, 1979 [JP] Japan ..... 54-41504

[51] Int. Cl.[3] ..... B24B 5/04

[52] U.S. Cl. ..... 51/123 R; 51/165.81; 51/165.86

[58] Field of Search ..... 51/49, 72, 95 WH, 123 R, 51/165.71, 165.81, 165.86, 289, 327

[56] References Cited

U.S. PATENT DOCUMENTS

| | | | |
|---|---|---|---|
| 2,101,787 | 12/1937 | Amidon | 51/95 WH |
| 2,127,210 | 8/1938 | Dunbar | 51/95 WH |
| 2,612,736 | 10/1952 | Lewis | 51/289 R |
| 2,730,845 | 1/1956 | Ernst | 51/289 R |
| 2,748,540 | 6/1956 | St. George | 51/95 WH |
| 2,771,715 | 11/1956 | Wood | 51/165.81 |
| 4,027,245 | 5/1977 | Bourrat | 51/165.71 |

FOREIGN PATENT DOCUMENTS

| | | | |
|---|---|---|---|
| 667932 | 10/1929 | France | 51/123 R |

*Primary Examiner*—Nicholas P. Godici

*Attorney, Agent, or Firm*—Holman & Stern

[57] ABSTRACT

A double-head automatic grinding machine which comprises a machine base, a work table supported on the base for movement in the longitudinal direction of the base and supporting a main shaft support block and an opposing tail stock for pinching a workpiece therebetween, a grinding wheel support block movably supported on the machine base for movement towards and away from the table in a direction normal to the table movement path, a vertically movable lifting block slidably mounted in the grinding wheel support block and supporting a pair of grinding wheel shafts in a vertically spaced relationship.

2 Claims, 4 Drawing Figures

DOUBLE-HEAD AUTOMATIC GRINDING MACHINE

BACKGROUND OF THE INVENTION

This invention relates to a double-head automatic grinding machine.

When a hard and brittle workpiece, with sufficient margin for grinding is ground, the axis of one diamond cup-shaped grinding wheel can be positioned offset from the center axis of the workpiece by the distance corresponding to the effective radius (the distance from the axis of the wheel to one half of the wall thickness of the wheel) of the cutting end face of the grinding wheel. In this case the effective radius of the cutting end face of the grinding wheel is positioned in a position tangent to the outer periphery of the work and the work is ground with the rotation of the work and the feeding movement of the table maintained at a low speed. This results in spiral feed pitches being formed on the outer periphery of the work whereby coarse, medium and fine grinding stages can be effectively and simultaneously performed on the work. However, when the work is a crystal material (such as glass, quartz, ceramic or silicone), fine cracks tend to develop in the work outer periphery. Thus, in order to remove such cracks from the work surface, medium and fine grinding stages are further required. If the workpiece is a super hard metal, portions of the workpiece tend to break off to thereby make the grinding in a single stage difficult. The grinding operation has to be divided into a number of stages, the last of the stages or the fine grinding then has to be performed by a grinding wheel different from the grinding wheel employed in the preceding grinding stages.

SUMMARY OF THE INVENTION

Therefore, the present invention is to provide a double-head automatic grinding machine which effectively performs the coarse, medium and fine grinding stages with the above fact in mind. For attaining the purpose, according to the present invention, two diamond cup-shaped grinding wheels of different grain sizes are employed for coarse, medium and fine grinding stages, respectively, that is, the coarser grinding wheel is for the coarse and medium grinding stages whereas the finer grinding wheel is for the fine grinding stage to thereby reduce the occurrence of cracks in the work being ground. The change from the coarser grinding wheel to the finer grinding wheel is automatically performed. A digital counter and a linear scale are employed to provide an output signal for selecting a minimum or maximum cutting value. The output signal is then fed into a digital limiter which automatically sets a number of cutting pitches or steps for each of the coarse and medium grinding stages and one pitch or step for the fine grinding stage, depending upon the input signal thereto. In this manner, the grinding on the workpiece can be gradually and stepwise performed.

The above and other objects and attendant advantages of the present invention will be more readily apparent to those skilled in the art from reading the following detailed description in conjunction with the accompanying drawings in which one preferred embodiment of the present invention is shown for illustration purpose only, but not for limiting the scope of the claims in any way.

BRIEF DESCRIPTION OF THE DRAWINGS

The accompanying drawings show one preferred embodiment of a double-head automatic grinding machine constructed in accordance with the present invention in which.

DETAILED DESCRIPTION

Figure 1:
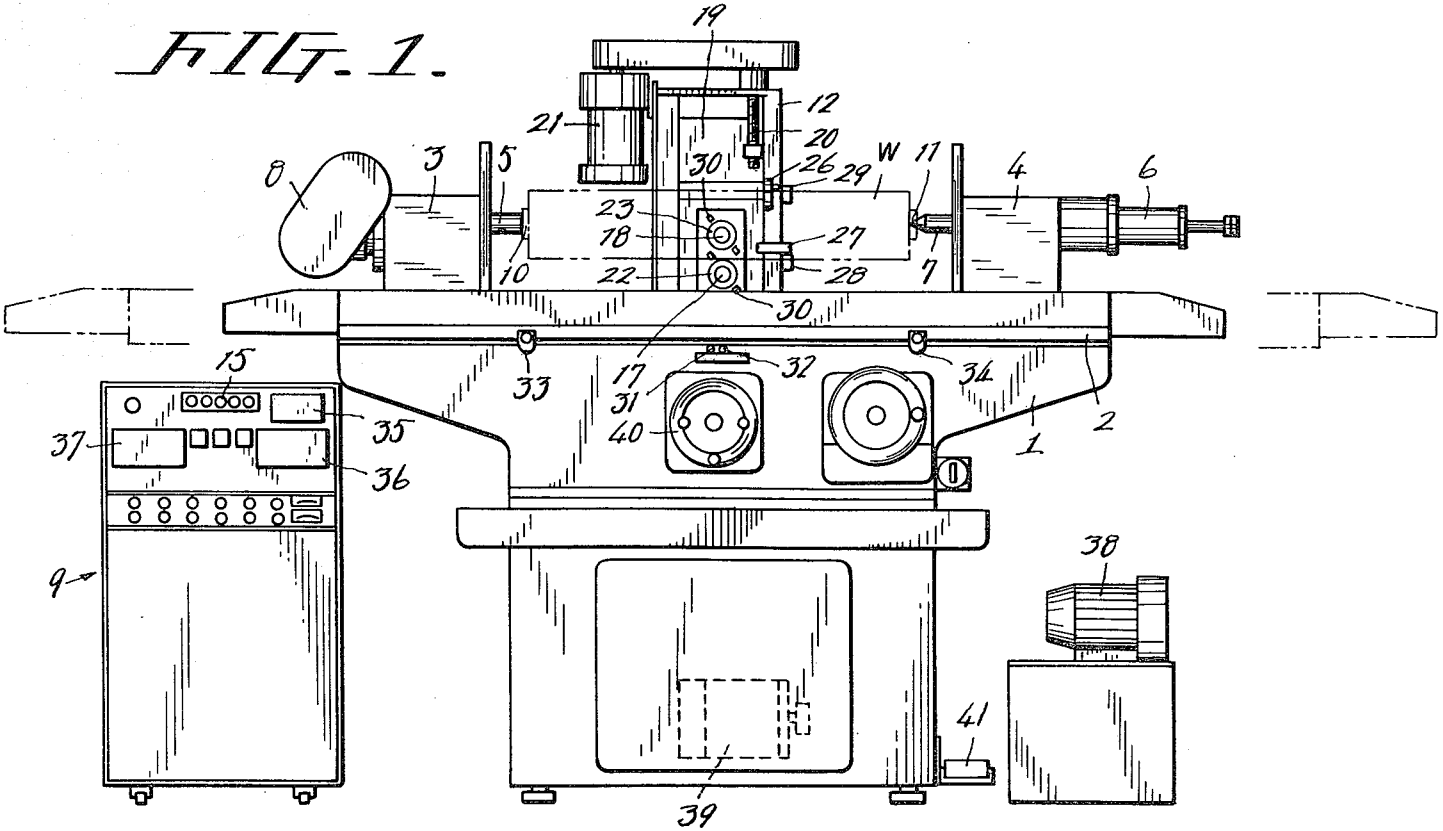
FIG. 1 is a front elevational view of said double head automatic grinding machine.

The present invention will be now described referring to the accompanying drawings which show one preferred embodiment of a double-head automatic grinding machine constructed in accordance with the present invention for illustration purpose only, but not for limiting the scope of the claims in any way.

The double-head automatic grinding machine of the invention generally comprises a stationary support base 1 on which a conventional work table 2 is movably supported for movement in the longitudinal direction of the base and carries a main shaft support block 3 and a tail stock 4 in an opposing and spaced relationship in a straight line on the upper surface of the table. The main shaft support block 3 rotatably supports a main or drive shaft 5 therein and the tail stock 4 movably supports a work center abutment rod 7 therein, respectively. The work center abutment rod 7 is movable between the advanced position in which the rod 7 abuts against the center of a workpiece to be processed and the retracted position in which the rod is separated from the work by the operation of an oil pressure-operated cylinder 6. The main shaft 5 is rotated from a motor 8 through a reduction gear (not shown) and the main shaft 5 and work center abutment rod 7 abut against attachments 10 and 11 respectively, each secured to the opposite ends of a workpiece W to be processed to thereby pinch the workpiece W therebetween. Thus, the rotation of the main shaft 5 is transmitted to the workpiece W.

The machine base 1 further mounts thereon a grinding wheel support block 12 which reciprocally moves in a direction normal to the movement path of the work table 2 on the support base 1.

Figure 2:
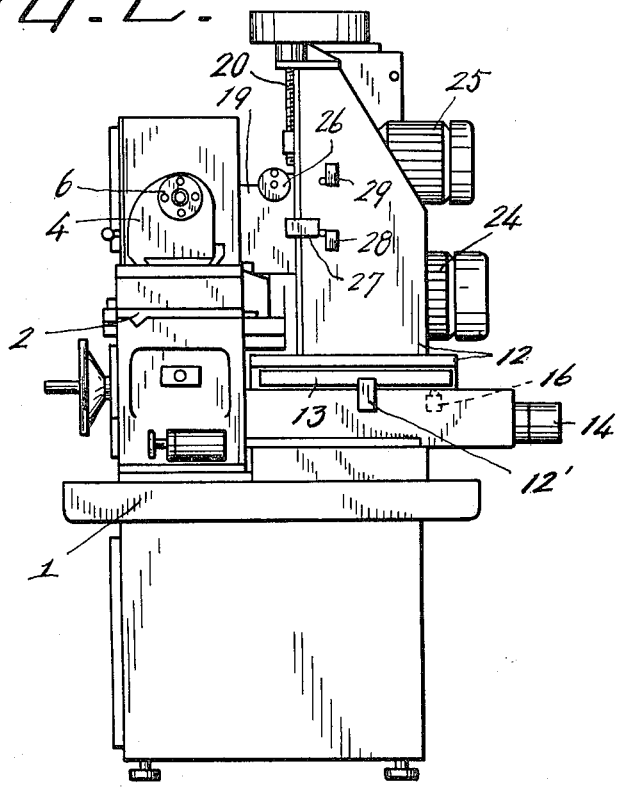
FIG. 2 is a side elevational view of said grinding machine.

A linear scale 13 (see FIG. 2) is mounted on one side of the grinding wheel support block 12. Support block 12 is movable on the support base 1 towards or away from the table 2 as a feed motor 14 mounted on the stationary support base 1 rotates in one or the other direction. The advance or retraction movement of the grinding wheel support block 12 is displayed on the digital display section 15 of a control board 9 which is operatively connected to the linear scale 13 whereby the operator can confirm the position of the grinding wheel support block 12 by observing an indication displayed in the display section 15.

A limit switch 16 is mounted on the stationary support base 1 in such a position that when the block 12 retracts to a predetermined retracted position, an operation member 12' secured to the side of the block 12 where the linear scale 13 is mounted engages the limit switch 16 to operate the switch whereby the block 12 ceases its retraction movement.

A threaded grinding wheel lifting block 19 is movably disposed within the grinding wheel support block 12 for vertical movement in the block 12 and supports lower and upper grinding wheel support shafts 17, 18 in a vertically spaced relationship. A threaded lifting rod 20 extends vertically within the block 12 and is rotatably supported on the block 12 in threaded engagement with the lifting block 19 so that as the threaded rod 20 is rotated in one or the other direction, the lifting block 19 moves upwardly and downwardly. For this purpose, the threaded rod 20 is operatively connected to a drive motor 21 mounted on the grinding wheel support block 12 through a transmission means such as an endless belt (not shown).

The grinding wheel support shafts extend towards the table 2 and support diamond cup-shaped grinding wheels 22, 23 having different grain sizes at the leading ends thereof, respectively. Grinding wheels 22, 23 are rotated at a predetermined high speed by motors 24, 25, respectively, which are mounted on the grinding wheel support block 12. For convenience of description, the lower grinding wheel 22 is assumed as the coarser grain size grinding wheel and the upper grinding wheel 23 is assumed as the finer grain size grinding wheel, respectively.

The lower and upper grinding wheel support shafts 17, 18 journalled in the threaded lifting block 19 can be selectively and finely adjusted by a fine adjustment handle 26 which moves the shaft 17 or 18 towards and away from the table 2 by a very limited distance when the wheel 22 or 23 is in the operative position. The threaded lifting block 19 further has an adjustable operation member 27 mounted thereon and the operation member 27 selectively engages limit switches 28, 29 mounted on the grinding wheel support block 12 to thereby control the vertical position of the threaded lifting block 19 with respect to the block 12. Such adjustment of the vertical position of the threaded lifting block 19 is so made that either one of the grinding wheels 22, 23 is in the operative position and the axis of the wheel 22 or 23 is so positioned with respect to the center axis of the workpiece W that the effective radius of the cutting end face of the wheel engages the outer periphery of the work.

A pair of cooling medium supply nozzles 30, 30 are provided on each of the cup-shaped grinding wheels 22, 23 adjacent to the working portion of the wheel to supply cooling medium from a cooling medium supply source (not shown) through the nozzles to the wheel to thereby prevent the overheating of the associated grinding wheel in grinding operation. Microswitches 31, 32 are mounted on the stationary support base 1 and adapted to be operated when operation members 33, 34 mounted on the table 2 engage the microswitches 31, 32, respectively as the table 1 moves in one and the other directions to thereby reverse the movement direction of the table 2.

Figure 4:
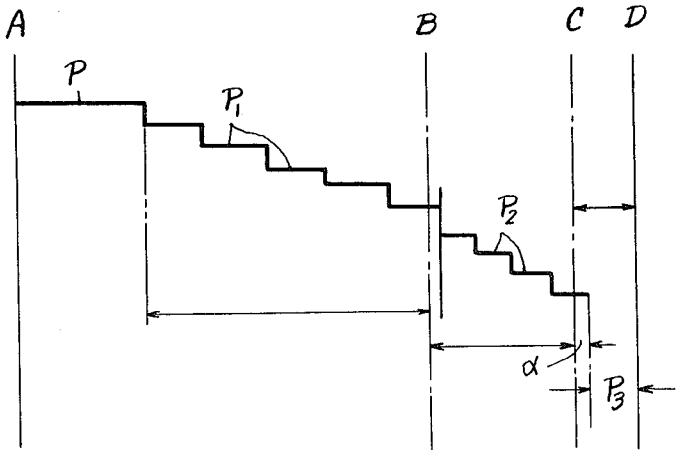
FIG. 4 is a schematic view showing various grinding stages in the grinding operation in the grinding machine.

The above-mentioned control board 9 includes a digital preset section 35, a medium grinding value set section 36, a fine grinding value set section 37 and the above-mentioned digital display section 15. The medium grinding value set section 36 sets the work feed pitch by means of a timer not shown; the grinding wheel support block feed screw is rotated from a motor through a reduction gear at a set time and the fine grinding value set section 37 sets a digital value representing the finish dimension D with the addition of a constant of an over ground amount $\alpha+$ the feed pitch $P_2$ (see FIG. 4).

Reference numeral 38 denotes an oil pump drive motor for the work center abutment rod, reference numeral 39 denotes a table feed motor, reference numeral 40 denotes a manual handle for the grinding wheel support block 12 and reference numeral 41 denotes a foot switch for the oil pressure cylinder 6.

Figure 3:
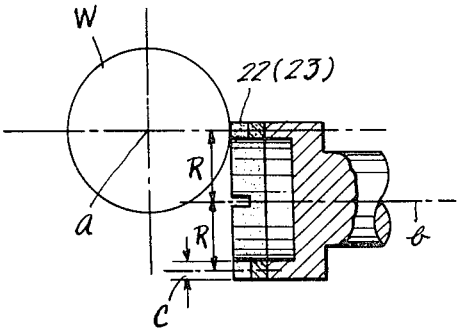
FIG. 3 is a fragmentary cross-sectional view showing the relationship between one grinding wheel and a workpiece to be processed in the grinding machine.

With the above-mentioned construction and arrangement of the parts of the grinding machine of the present invention the grinding machine operates as follows. Prior to a grinding operation in the grinding machine, the grinding wheel support shaft 17 is adjusted by the fine adjustment handle 26 through the employment of a dial indicator. Grinding wheel support shaft 17 is positioned with the effective radius R of the cutting end face of the grinding wheel 22 (the distance from the axis of the wheel to one half of the wall thickness C of the wheel) in a position tangent to the outer periphery of the workpiece W with a tolerance within 0–0.01 mm. The effective radius R of the cutting end face of grinding wheel 22 is brought into contact with the outer periphery of the workpiece at right angles thereto with the axis b of the grinding wheel offset from the center axis a of the workpiece W by the distance corresponding to the effective radius R as shown in FIG. 3. After the adjustment, the grinding wheel 22 which is now in the operative position is advanced while being first manually rotated until the wheel abuts against the work center abutment rod 7 whereupon the known diameter of the rod 7 is digitally displayed in the digital display section 15. After one grinding operation has been performed on the workpiece W, the finished diameter of the workpiece W is measured by the use of a micrometer and if it has been found that the finished diameter is deviated from a preset value, the digital preset section 35 corrects the digital display to the correct value. If the cutting is insufficient, the manual cutting handle 40 is manipulated to move the grinding wheel support block 12 to a position in which the grinding wheel cuts the workpiece W to the preset finish diameter. Furthermore, with the grinding wheel positioned in the initial position (the starting position for the first grinding operation), even when the digital setting representing the position is set in the digital preset section 35 and the power source for the machine is disconnected, the starting position of the grinding wheel for the regrinding operation can be instantly determined.

With the digital setting of the starting position of the grinding wheel for the regrinding operation set in this manner, the grinding wheel is linearly advanced to a position in which the grinding wheel is just about to grind a portion of the coarsely ground portion of the workpiece W. As the wheel is about to grind a portion of the workpiece the switch push button is depressed down and the coarse grinding feed pitch $P_1$ is set for a certain time period such as 5 seconds, for example, for the cutting shown in FIG. 4, and the table 2 moves in one and the other directions. As the table 2 moves in one and the other directions, the switch operation member 33 or 34 operates the microswitch 31 or 32 whereby cutting operations in successive steps are automatically performed. As the cutting operation reaches the present medium cutting value at Point B, when the feed pitch is set as 2 seconds, for example, by the timer for automatic cutting and the table 2 is moved in one and the other directions either one switch operation member operates the associated microswitch in the same manner as mentioned hereinabove in connection with the coarse cutting reaching Point C. Point C indicates where the medium cutting terminates and the fine cutting begins. The motor 21 operates in response to a signal from the control board 9 to lower the threaded lifting block 19 and the grinding wheel 22 which has performed the coarse and medium grinding stages is replaced by the grinding wheel 23 which performs the fine grinding stage. The fine cutting is then automatically performed on the semi-processed workpiece W until workpiece W is processed to the diameter as shown at Point D. After the fine cutting, when the table is moved in one direction and one of the switch operation members on the table operates the associated microswitch, the fine cutting operation terminates.

As mentioned hereinabove, according to the present invention, the grinding wheel support lifting block 19 supports the grinding wheel shaft 17 and 18 in vertically spaced relationship. Grinding wheel shafts 17 and 18 are operatively connected to the motor 21 and movably mounted within the table 2 which has the linear scale 13 operatively connected thereto. The control board 9, using a digital limiter for selecting minimum and maximum cutting values, can set the pitch or pitches for three cutting stages. With this apparatus, the cutting accuracy is enhanced, and automatic cutting can be easily performed to thereby save labour and attain high grinding efficiency.

While only one embodiment of the invention has been shown and described in detail, it will be understood that the same is for illustration purpose only and is not to be taken as a definition of the invention, reference being had for this purpose to the appended claims.

What is claimed is:

1. In a double-head automatic grinding machine comprising: a stationary support base; a motor driven table supported on said support base for movement in the longitudinal direction of the support base; a main shaft support block mounted on said table and supporting a motor driven main shaft; a tail stock mounted on said table in opposition to said main shaft support block and supporting a work center abutment rod so as to pinch a workpiece between the main shaft and said rod; a motor driven grinding wheel support block mounted on said stationary support base for movement in a direction normal to the movement direction of said table; and cup-shaped coarser and finer grinding wheels mounted on said grinding wheel support block so that movement of said block displaces said cup-shaped coarser and finer grinding wheels at right angles to the center axis of the workpiece, whereby said workpiece rotating at a low speed is moved in the longitudinal direction of said support base as said table is moved in the same longitudinal direction by a motor, the improvement comprising said grinding wheel support block includes a threaded lifting block slidably received in the grinding wheel support block, two grinding wheel shafts rotatably mounted in said lifting block in vertically spaced relationship, means for finely adjusting said grinding wheels with respect to said workpiece, a control board, and a linear scale secured to one side of said grinding wheel support block and operatively connected to said control board, each of said cup-shaped grinding wheels being mounted on each of said shafts so that the axes of the wheels are offset from the center axis of said workpiece by the distance corresponding to the effective radius of the wheels, and means to operate said lifting block so that the coarse and fine grinding wheels are automatically replaced by each other according to an optional cutting amount and frequency comprising a motor operatively connected to said lifting block and to said control board, said control board employing a digital limiter for selecting minimum and maximum cutting amounts.

2. The double-head automatic grinding machine as set forth in claim 1, wherein said means to operate said lifting block in the grinding wheel support block comprises a vertical threaded rod rotatably supported in the block and in threaded engagement with said lifting block so that as said threaded rod is rotated said lifting block is moved vertically, a pair of spaced limit switches mounted on said grinding wheel support block and a switch operation member adjustably mounted on said lifting block to selectively engage said limit switches so as to control the vertical position of said lifting block.

* * * * *